US011352027B2

(12) United States Patent
Ding et al.

(10) Patent No.: US 11,352,027 B2
(45) Date of Patent: Jun. 7, 2022

(54) HEAD MODULE FOR A RAIL VEHICLE

(71) Applicants: CRRC QINGDAO SIFANG CO., LTD., Shandong (CN); CG RAIL—CHINESISCH-DEUTSCHES FORSCHUNGS—UND ENTWICKLUNGSZENTRUM FÜR BAHN—UND VERKEHRSTECHNIK DRESDEN GMBH, Dresden (DE)

(72) Inventors: Sansan Ding, Shandong (CN); Yuanmu Zhong, Shandong (CN); Hengkui Li, Shandong (CN); Xiangang Song, Shandong (CN); Lu Jin, Shandong (CN); Qinfeng Wang, Shandong (CN); Bingsong Wang, Shandong (CN); Werner Hufenbach, Dresden (DE); Andreas Ulbricht, Dresden (DE)

(73) Assignees: CRRC QINGDAO SIFANG CO., LTD., Shandong (CN); CG RAIL—CHINESISCH-DEUTSCHES FORSCHUNGS—UND ENTWICKLUNGSZENTRUM FÜR BAHN—UND VERKEHRSTECHNIK DRESDEN GMBH, Dresden (DE)

( * ) Notice: Subject to any disclaimer, the term of this patent is extended or adjusted under 35 U.S.C. 154(b) by 408 days.

(21) Appl. No.: 16/484,069

(22) PCT Filed: Feb. 2, 2018

(86) PCT No.: PCT/EP2018/052643
§ 371 (c)(1),
(2) Date: Aug. 6, 2019

(87) PCT Pub. No.: WO2018/146014
PCT Pub. Date: Aug. 16, 2018

(65) Prior Publication Data

US 2020/0010098 A1 Jan. 9, 2020

(30) Foreign Application Priority Data

Feb. 9, 2017 (DE) ..... 10 2017 102 567.7

(51) Int. Cl.
*B61D 15/06* (2006.01)
*B61D 17/00* (2006.01)
(Continued)

(52) U.S. Cl.
CPC ..... *B61D 15/06* (2013.01); *B61D 17/005* (2013.01); *B61D 17/045* (2013.01); *B61D 17/06* (2013.01)

(58) Field of Classification Search
CPC .... B61D 15/06; B61D 17/005; B61D 17/045; B61D 17/06
See application file for complete search history.

(56) References Cited

U.S. PATENT DOCUMENTS 6,431,083 B1 8/2002 Carstensen et al.
2007/0186802 A1 8/2007 Gough
(Continued)

FOREIGN PATENT DOCUMENTS

CN 101801756 A 8/2010
CN 102216141 A 10/2011
(Continued)

OTHER PUBLICATIONS

First Office Action dated May 26, 2020 for Chinese patent application No. 201880009591.5, English translation provided by Global Dossier.
(Continued)

*Primary Examiner* — Robert J McCarry, Jr.
(74) *Attorney, Agent, or Firm* — Yue (Robert) Xu; Apex Attorneys at Law, LLP

(57) ABSTRACT

The invention relates to a head module for a rail vehicle, said head module being suitable to be detachably fixed to the front face of a subsequent railcar unit without additional underframe. The head module consists of an inner and an outer shell and includes three systems which convert, in the event of a crash, the collision energy into a deformation one after the other or simultaneously and substantially independently of another.

9 Claims, 6 Drawing Sheets

Figure 1:
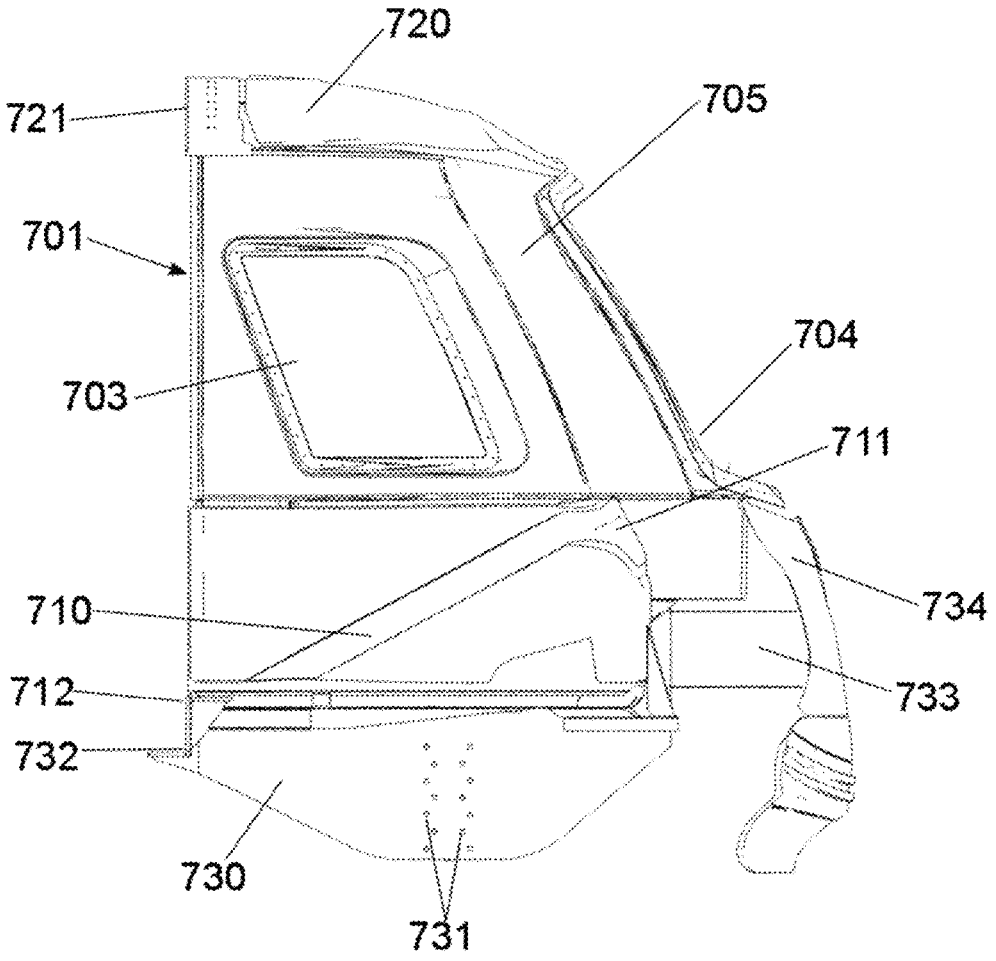

(51) Int. Cl.
*B61D 17/04* (2006.01)
*B61D 17/06* (2006.01)

(56) References Cited

U.S. PATENT DOCUMENTS

| | | | |
|---|---|---|---|
| 2010/0064931 | A1 | 3/2010 | Heinisch et al. |
| 2010/0218701 | A1 | 9/2010 | Graf et al. |
| 2015/0033978 | A1 | 2/2015 | Oohashi et al. |
| 2016/0339821 | A1 | 11/2016 | Akaike et al. |

FOREIGN PATENT DOCUMENTS

| | | | | | |
|---|---|---|---|---|---|
| CN | 106347387 | A | | 1/2017 | |
| DE | 19725905 | A1 | | 12/1998 | |
| DE | 69818357 | T2 | | 6/2004 | |
| DE | 602004009942 | T2 | | 10/2008 | |
| DE | 602005004131 | T2 | | 12/2008 | |
| DE | 102014204761 | A1 | | 9/2015 | |
| DE | 102014218413 | A1 | | 3/2016 | |
| FR | 2698840 | A1 | | 6/1994 | |
| GB | 2411630 | A | | 9/2005 | |
| JP | 2013237415 | A | | 11/2013 | |
| JP | 2014088177 | A | * | 5/2014 | ..... B61D 17/06 |
| JP | 2014088177 | A | | 5/2014 | |
| JP | 2016215896 | A | | 12/2016 | |
| WO | 2008034745 | A1 | | 3/2008 | |
| WO | 2009040309 | A1 | | 4/2009 | |
| WO | 2009072843 | A2 | | 6/2009 | |
| WO | 2010029188 | A1 | | 3/2010 | |
| WO | 2015011193 | A1 | | 1/2015 | |

OTHER PUBLICATIONS

First Office Action dated Aug. 31, 2020 for Japanese patent application No. 2019-563675, English translation provided by Global Dossier.

International Search Report for PCT/EP2018/052643 dated May 4, 2018, ISA/CN.

* cited by examiner

HEAD MODULE FOR A RAIL VEHICLE

CROSS-REFERENCE TO RELATED APPLICATIONS

This application is the national phase of International Application No. PCT/EP2018/052643, titled "HEAD MODULE FOR A RAIL VEHICLE", filed on Feb. 2, 2018, which claims the priority of German patent application No. 102017102567.7 filed on Feb. 9, 2017, the entire disclosures of the applications are incorporated herein by reference.

The present invention relates to a construction for a head module for a rail vehicle, which is suitable for dissipating and distributing the loads that occur in the event of a crash.

In particular it is a head module for commuter trains, in particular underground trains. In such trains, the head module is often integrated into the coach. The head module is also referred to as cab in the following, wherein it does not necessarily form a separate compartment.

In the interests of material and energy efficiency, in recent years the use of light materials and of the principles of lightweight construction has become increasingly established in rail vehicle construction. In particular the use of fibre composite materials is constantly increasing. This also applies to the design of the head modules of rail vehicles.

Known constructions here provide for attaching prefabricated modules to the substructure, which runs through the entire coach without interruption.

Thus DE 197 25 905 relates to a method for connecting a prefabricated head module made of fibre-reinforced plastic (FRP) to the underframe and the coach body module. The side walls of the head module are preferably manufactured as a sandwich structure made of FRP with a core material in between. Here, special reinforcing profiles are used in the joining areas of the head module, which improve the force transmission between underframe or coach module and the FRP walls of the head module. A special design of the fibre direction of the FRP reinforcement is not provided. The reinforcing profiles are integrated into the core of the FRP walls of the head module and act as support for the bolt connection between FRP walls of the head module and underframe or coach body module. A disadvantage here is that the reinforcing fibre material between the reinforcing profile and the underframe is subjected to a compressive load and there is thus the risk of damage, due to creep, to the FRP material in this area.

DE 10 2014 204 761 A1 deals with the problem of crash safety, in particular of the front panel, in the case of the rail vehicle header modules. It is provided that the frame of the front panel has a deformation element which can absorb energy and dissipate it through its deformation. The front panel is as far as possible to move out of the frame without the formation of fragments.

This is realized in DE 10 2014 204 761 A1 in that predetermined breaking points are provided in the frame of the front panel or in proximity thereto. The predetermined breaking points are produced through the geometric design, the dimensioning of the deformation element or the material thereof. In one embodiment, the deformation element is to run partly or completely around the front panel. The frame can also be formed by the vehicle shell itself.

DE 60 2004009942 T2 deals with an impact energy absorption system for a light rail vehicle. The crash system described is predominantly arranged in the lower area of the vehicle; the passenger area is also surrounded by a protective cage.

WO 2015/011193 A1 relates to an energy absorption device for rail vehicles. The purpose of this device is to absorb a portion of the impact energy and to convert it into material deformation in the event of a crash. For this a three-dimensionally formed body made of FRP is used. This has layers with unidirectionally oriented fibres and layers with fibres arranged omnidirectionally (randomly oriented fibres). The energy absorption is realized in particular in that a counter-element strikes the energy absorption element in the longitudinal direction and destroys, in particular by fibrous disintegration, the ply or plies with randomly oriented fibres. The arrangement of the fibres without a preferred direction guarantees that the impact energy is converted when the fibres are broken down and does not lead to a delamination of different fibre layers.

WO 2010/029188 A1 discloses a self-supporting vehicle front-end which is preferentially composed of fibre composite material. The vehicle front-end has structural elements which serve to absorb energy in the event of a crash as well as other structural elements which do not have a specific function for energy dissipation. In particular, the energy-absorbing structural elements are also to consist of fibre composite material. It is furthermore provided that a series of energy-dissipating structural elements successively contributes to the energy absorption or transmits corresponding forces. The vehicle front-end has a central buffer coupling which due to its design lies in front of the external cladding of the vehicle front-end. An energy absorption element that is to absorb impacts exerted on the central buffer coupling is therefore arranged directly behind the central buffer coupling. In addition, two lateral energy absorption elements are arranged parallel thereto, which are to act as anti-overriding protection. Furthermore, the railing underneath the front window has at least one, preferably two, energy absorption elements. On each side of the front-end section, two lines for energy transmission lead from the railing into the substructure of the coach section. In addition, two energy absorption elements are arranged in front of the two A pillars in the direction of movement. The A pillars are designed to conduct kinetic energy into the roof structure and to dissipate in a controlled manner any impact energy still remaining in the event of a crash. This is necessary as conventional coach section constructions do not have any longitudinal beams arranged in the roof area, which could absorb portions of the impact energy. A disadvantage here is that a force exerted on the railing in conjunction with the two lateral lines for energy transmission can lead to a lever action on the roof construction, which sets the latter in motion, substantially perpendicular to the direction of movement of the vehicle. This can at least reduce the ability of the roof construction to absorb remaining impact energy. There is thus a disadvantageous coupling of safety systems.

DE 60 2005 004 131 T2 describes a frame for a vehicle front-end in which several yieldable regions are distributed. The document does not feature a self-supporting vehicle front-end. The frame is designed such that as extensive an energy absorption as possible takes place in the yieldable regions thereof. The roof and base portions of the frame are therefore not preferentially formed to conduct forces into the following coach body.

The named solutions are suitable for trains which can be exposed to a plurality of different collision opponents. The solutions applied are accordingly complex. The object is thus to propose a system of protective devices for a head module which are suitable in particular for underground trains and similar applications which operate on separate route networks and can be exposed to largely only similarly constructed collision opponents. In particular, a continuous substructure which reaches from the coach section into the head module should not be necessary.

In order to satisfy this object, the head module has to be suitable to be able to be placed in front of the corresponding coach sections. For this, the design features of these coach sections are to be taken into consideration.

In the present case, the sub-object is to be able to install the head module according to the invention on a coach section which is characterized by corresponding interface components. These are in particular:

- two longitudinal beams of the underframe, which extend in the longitudinal direction on the lower edges of the coach section and the end faces of which are suitable for the installation of the head module,
- an underframe support for the driver's cab, which runs between the two longitudinal beams of the underframe and opens into the main cross beam which is mounted in the bogie of the coach section. The main cross beam is supported in the two longitudinal beams of the underframe. The underframe support for the driver's cab and the main cross beam are preferably manufactured from steel.
- two longitudinal beams of the coach roof, which extend in the longitudinal direction on the upper edges of the coach section and the end faces of which are suitable for the installation of the head module.

The longitudinal beams are preferably manufactured from fibre composite material. All interface components have corresponding fixing options for the corresponding components of the cab. These are preferably detachable fixings, quite particularly preferably screw connections.

The head module according to the invention has three systems which convert the impact energy through irreversible deformation in the event of a crash. These systems are largely constructed independently of one another and can thus advantageously act one after the other or simultaneously without the crash-induced destruction of one system being able to impair the effectiveness of the other. The systems are substantially manufactured from fibre composite material.

The three systems are:

1. a stiffener designed as a ring beam in the roof area of the cab, which conducts forces into the upper longitudinal beams of the following coach section,
2. a railing reinforcement which conducts impact forces into the lower longitudinal beams of the following coach section via UD braces running on the sides of the cab (UD braces are components reinforced particularly with fibres that run unidirectionally, in the direction of the load, or reinforced areas in components),
3. a lower crash conduction element which is fitted with a crash box and in addition conducts the remaining impact energy into the underframe support.

The three crash systems thus conduct the remaining impact forces into different components of the following coach section, which optionally have energy absorption elements themselves.

The driver's cab is preferably formed as a two-shell construction. The outer shell is connected to the three systems which convert the impact energy into deformation in the event of a crash. The inner shell lines the actual interior space which can be used by people. Both shells are formed as fibre composite structures which do not make any significant contributions to the crash resistance. The outer shell guarantees the necessary stiffness of the construction in that it is realized as a multilayered fibre composite structure, optionally with cores lying between the fibre layers. Laid, twisted or braided fibre fabrics can be used in the fibre layers. To improve the stiffness, UD fibre strands (unidirectional fibre strands) are also possible. It is advantageous that the A pillars of the outer cab have no special reinforcements for the force transmission in the event of a crash. This prevents a disadvantageous force transmission onto the ring beam from occurring in the event of a crash or at least limits it. The A pillars of the outer cab are preferably designed for the feeding-through of electrical wires. The outer cab shell is preferably constructed from fibre non-crimp fabrics which are then impregnated with a matrix material and consolidated. The construction from fibre non-crimp fabrics pre-impregnated with matrix material is also possible. The outer shell is preferably connected to the inner shell in the area of the front and side windows. Here the two shells are screwed, adhesively bonded or connected to each other in another way also combining various methods. The front window is preferably glued into the outer shell. Predetermined breaking points, which guarantee that the front window breaks away from the frame in the event of a crash and no or only a few fragments reach the interior, are preferably provided. In a further preferred embodiment, the front window has its own frame with which it is fixed in the outer shell. Predetermined breaking points are also preferred here.

The ring beam has a U shape in which the two ends of the ring beam are fixed to the upper longitudinal beams of the following coach section. The front surface of the ring beam (corresponds to the lower curvature of the U shape) is arranged on the inner surface of the upper front side of the outer cab shell. The ring beam is preferably designed as a fibre composite component. UD fibre plies which run over the entire length of the ring beam, from one fixing point on an upper longitudinal beam of the following coach section to the other fixing point on the other upper longitudinal beam of the following coach section, are used for the ring beam here. These UD fibre plies can be used alternating with fibre plies which can have differing fibre orientations. Plies of semi-finished fibre products such as woven fabrics or non-crimp fabrics are preferred. In particular, fibre plies with differing orientations or woven fabric or meshwork are used to hold the UD fibres in place before the consolidation. The ring beam is preferably manufactured together with the outer cab shell. Here, a ring beam moulded part that already has the fibre-reinforcing structure of the ring beam is placed in the mould in which the outer cab shell is manufactured. The fibre plies of the ring beam and of the outer cab shell are then impregnated with matrix material together and this is then consolidated (the matrix material is cured). It is also possible to pre-impregnate the ring beam moulded part with matrix material and then place it in the mould or place it on a support construction on which the further fibre plies of the outer shell are then placed, likewise as pre-impregnated fibre plies (e.g. as pre-pregs). Here too this is then consolidated.

A further preferred embodiment provides manufacturing the outer cab shell and the ring beam as separate components and introducing the consolidated ring beam into the consolidated outer cab shell and fixing it there, preferably gluing it in.

The railing reinforcement is likewise designed as a fibre-reinforced component. It is arranged underneath the front window and above the crash box of the head module. It extends over the entire width of the front of the cab underneath the window and above the crash box of the lower crash conduction element. Optionally the railing reinforcement can be split or designed with a lower material thickness in the centre. Inclined UD braces which introduce a portion of the crash energy into the lower longitudinal beams of the coach section run on the sides in the outer shell of the cab from the lateral ends of the railing reinforcement. Both the railing reinforcement and the UD braces are composed of fibre-reinforced material. They are also inserted as prefabricated components during the manufacture of the inner cab shell in analogy to the procedure in the case of the ring beam and consolidated. In this way the railing reinforcement is completely integrated into the inner shell. Contrary to the solution from WO 2010/029188 A1, because the A pillar of the present construction does not play a particular role in the event of a crash and in particular is not reinforced, a collision with the railing reinforcement cannot have an adverse effect on the ring beam in the roof area as the A pillar cannot transmit larger forces in this direction.

The head module has a flat nose. Force components in the vertical direction, which cause overriding, are thereby effectively prevented. This approach is advantageous as only identical train units can come together. A plate made of fibre-reinforced plastic is arranged underneath the railing reinforcement and above the central buffer coupling. This reaches substantially over the entire width of the front of the cab. Narrower designs are optionally possible. In the central part of the plate, the latter is thickened at the point which lies in front of the crash box. The plate, together with the crash box and the lower crash conduction element, forms a safety system which diverts the forces still arising behind the crash box into the underframe support of the following coach. In the event of a collision the thickened part is broken out of the plate (in the process absorbs a portion of the energy) and the further movement is absorbed by the crash box which converts it into deformation energy. The crash box has a structure known from the state of the art. In particular, it preferably consists of metal foam which is compressed in the crash under energy absorption.

The lower crash conduction element is curved in such a way that it runs in the area of the inner shell underneath the cab base and only rises in the interface area to the underframe support to the level thereof in order to make the installation possible. This is also preferably effected here with detachable metallic connections, preferably screw connections. In a particularly preferred embodiment, the crash conduction element is constructed double-angled. It runs from the crash box, which is arranged underneath the railing and above the central buffer coupling, diagonally downwards to underneath the base of the inner shell. There it changes direction into the horizontal to approximately the end of the base of the inner shell. Here it rises diagonally to the connection interface to the underframe support. The included angles between the horizontal and the angled sections of the crash conduction element preferably lie in the range between 30° and 60°. The lower crash conduction element is preferably manufactured from fibre composite material. It has a U-shaped cross section open towards the bottom (or right-angled cross section, open towards the bottom). This guarantees a particularly high stiffness even in the event of a crash. The central buffer coupling is arranged on the lower crash conduction element after the first curvature (after the section which leads from the crash box to the horizontal section of the lower crash conduction element). This is preferably effected via a metallic installation element which is fixed to the arms of the U-shaped cross section pointing downwards, preferably by means of a bolt or screw connection. The central buffer coupling is fixed to the installation element.

The central buffer coupling has a telescopic construction. It can be moved from a rest position, in which it is housed behind a flap in the front side of the head section, into a working position, in which the coupling of further train sections is possible. The central buffer coupling in addition has an energy absorption element according to the state of the art. This energy absorption element converts a portion of the impact energy into deformation work in the event of a crash, if the collision takes place while the central buffer coupling is in the working position.

Fibre composite materials are used as preferred materials for the cab shells and the three systems for the event of a crash. Fixing elements etc. can advantageously be manufactured from metal. The fibre composite materials are preferably plastics, preferably resins, particularly preferably epoxy resins or phenolic resin systems, reinforced with carbon fibres, glass fibres or basalt fibres.

The construction of the cab and the design of the systems are preferably effected using computer-aided simulation processes, which allow the design to be carried out in accordance with the regulations in force. The simulation processes and computer-aided design tools are known to a person skilled in the art.

The following figures illustrate a preferred embodiment of the head module for a rail vehicle designed according to the invention.

FIG. 1 shows a schematic side view of the cab according to the invention without the outer shell. The central buffer coupling has also been omitted for the sake of clarity. The inner shell 701 is designed in two parts. The division occurs in the horizontal plane above the railing reinforcement 711. The upper part of the inner shell 701 comprises the opening 704 for the front window and the side windows 703. The window openings are separated from each other by the A pillar 705. Above the upper part of the inner shell the ring beam 720 is represented. It is detachably fixed to the upper longitudinal beams of the following coach section (not represented) via the fixing device 721. In preferred embodiments, the ring beam 720 is non-detachably connected to the outer shell (not represented here).

The railing reinforcement 711 and the UD braces 710 which transmit the force from the railing reinforcement 711 to the introduction points 712 into the lower longitudinal beams of the following coach section are integrated into the lower part of the inner shell.

The lower crash conduction element 730 runs underneath the lower part of the inner shell. On the front side of the cab the plate 734 is represented. The crash box 733 is arranged behind it. In the event of a crash, the collision takes place on the plate 734, which passes the force onto the crash box 733 and dissipates it as far as possible there. Remaining impact energy is passed on into the lower crash conduction element 730 and there is transferred at the fixing point 732 into the underframe support of the following coach section. In the horizontal section of the lower crash conduction element 730, the openings 731 for fixing the central buffer coupling are visible.

Figure 2:
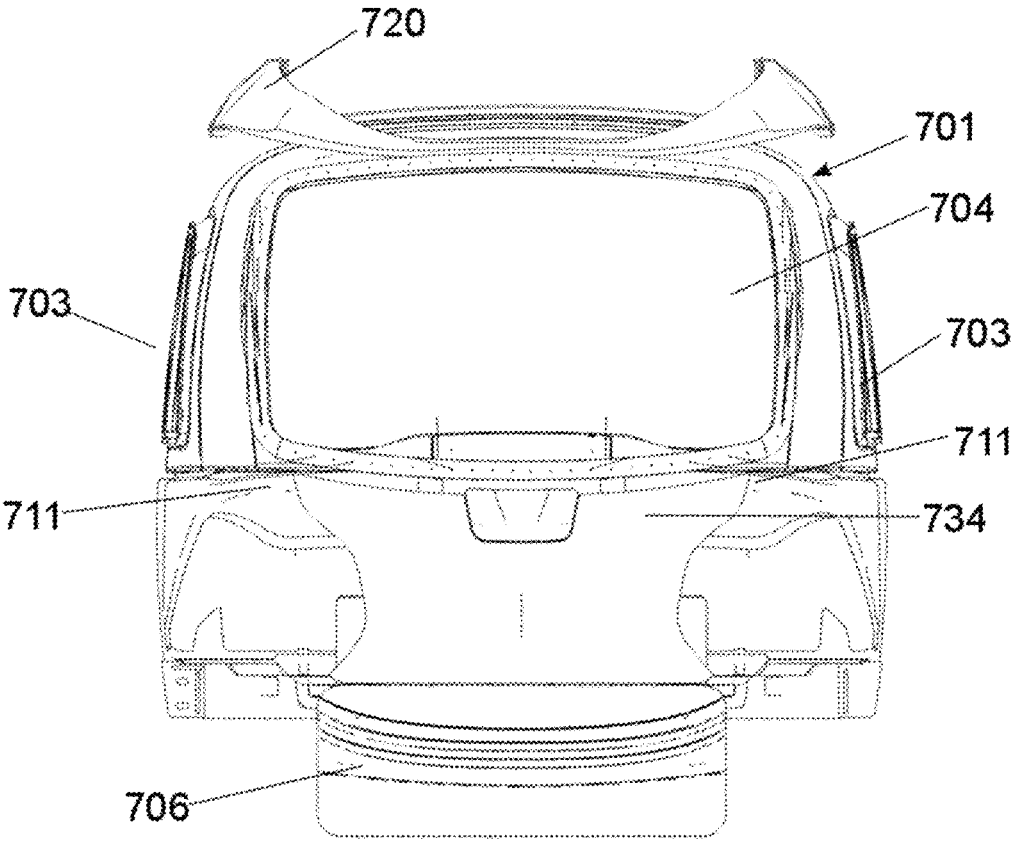

FIG. 2 shows the schematic front view of the cab without the outer shell. Compared with the side view from FIG. 1, the cover flap of the central buffer coupling with the reference number 706 is additionally provided, which fits into a corresponding opening in the outer shell.

Figure 3:
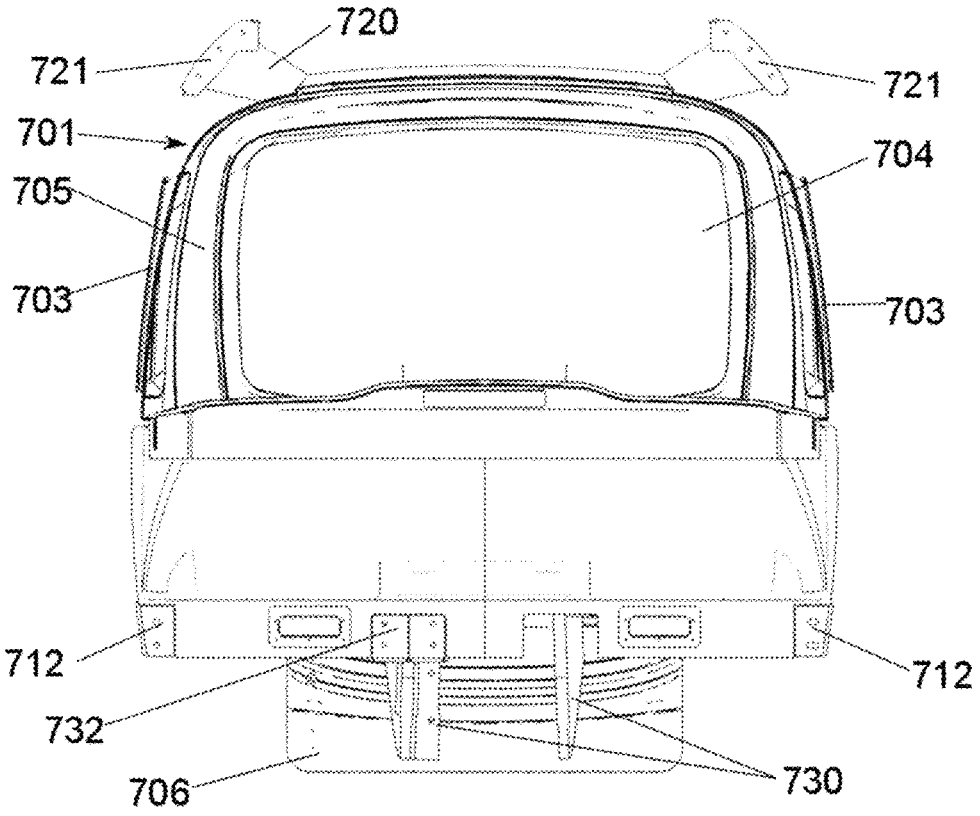

FIG. 3 shows the schematic rear view of the inner shell of the cab. This is the side with which the cab is installed on the following coach section. The installation is preferably effected on the two upper longitudinal beams of the following coach section by means of the fixing elements 721 of the upper ring beam, by means of the fixing elements at the introduction points 712 of the UD braces from the railing reinforcement and by means of the fixing device 712 (only one is represented, a second is arranged symmetrically on the right-hand side) of the lower crash element on the underframe support.

Figure 4:
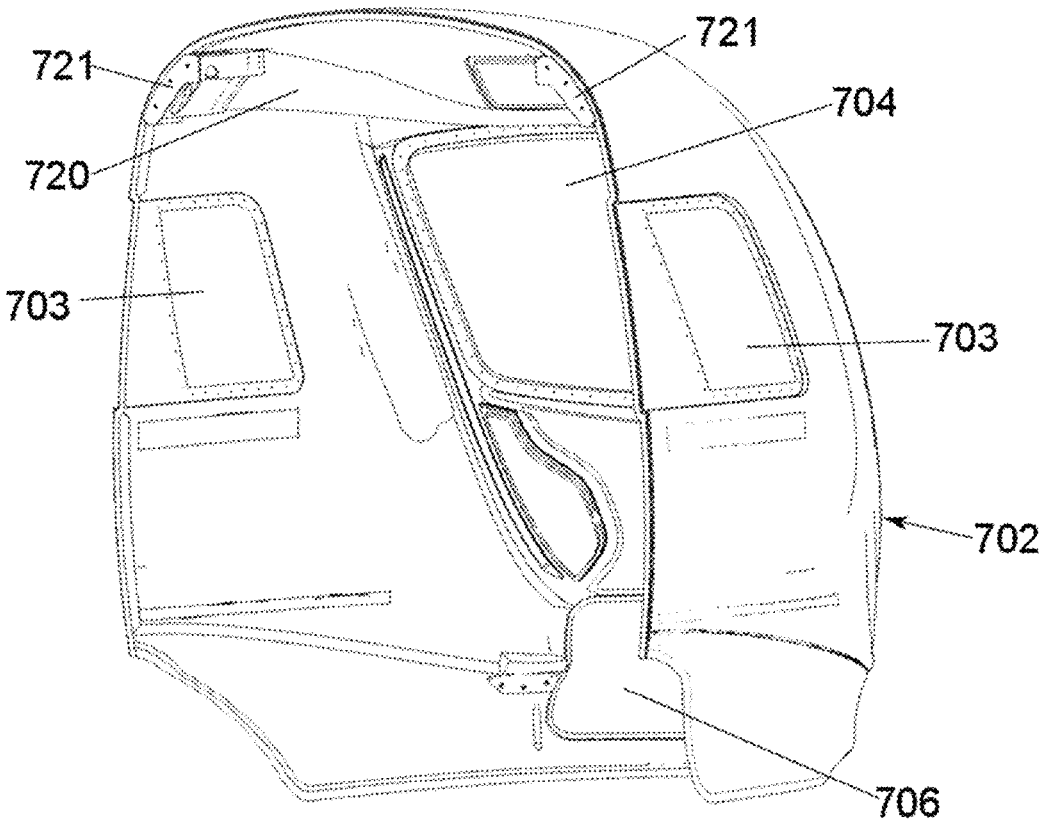

FIG. 4 shows a schematic three-dimensional view of the outer shell 702. In particular, it can be seen how the upper ring beam 720 with its fixing elements 721 fits into the outer shell 702. The opening for the cover flap 706 of the central buffer coupling is also represented.

Figure 5:
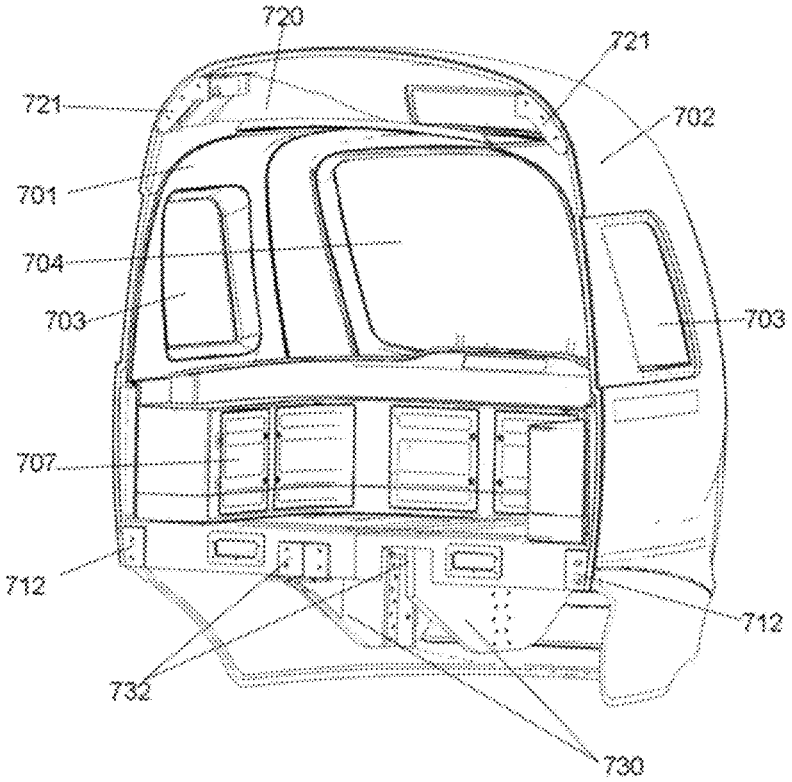

FIG. 5 shows, schematically, how the inner shell 701 is fitted into the outer shell and, by way of example, how the internal fittings 707 can be arranged.

Figure 6:
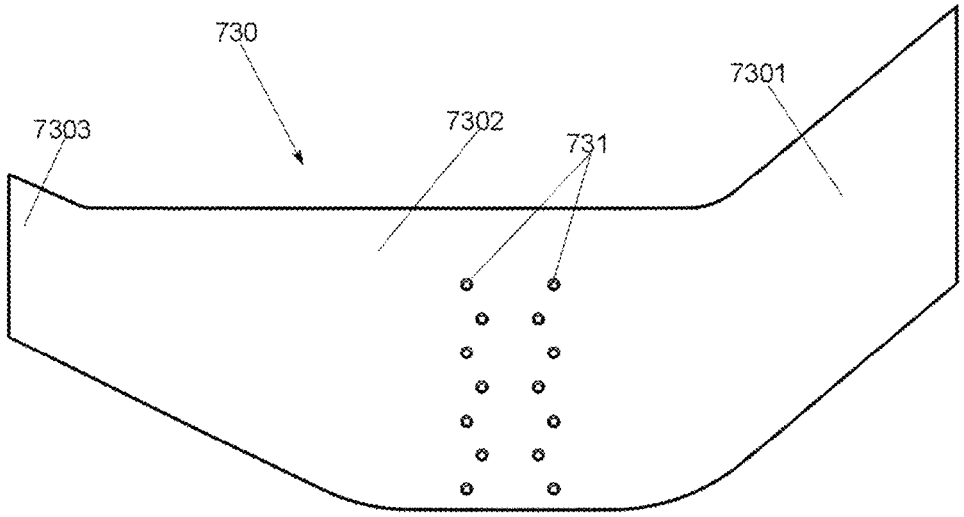

FIG. 6 shows a schematic side view of the crash conduction element 730. The crash conduction element has a downward sloping area 7301 in which it runs from the crash box (not represented) to the horizontal section 7302. With the upward sloping section 7303 the crash conduction element runs from the horizontal section to the connection point to the central buffer coupling (not represented).

Figure 7:
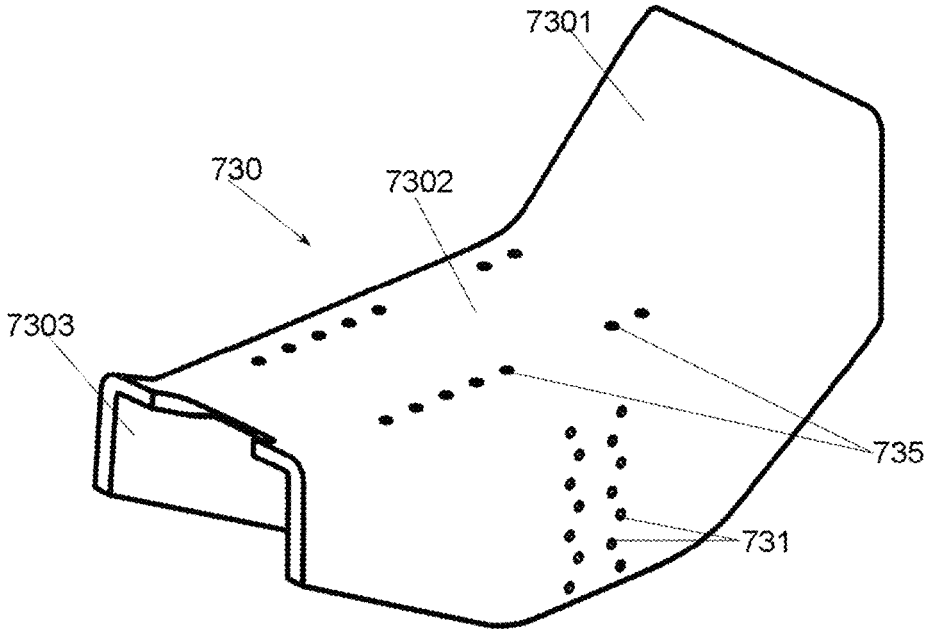

FIG. 7 shows a schematic 3D view of the crash conduction element 730 from FIG. 6.

LIST OF REFERENCE NUMBERS

701 inner shell
702 outer shell
703 side window opening
704 front window opening
705 A pillar
706 cover flap of the central buffer coupling
707 internal fittings
710 UD brace of the railing reinforcement
711 railing reinforcement
712 introduction point of the forces from the railing reinforcement into the lower longitudinal beam of the following coach
720 ring beam
721 fixing device of the ring beam to the upper longitudinal beam of the following coach
730 lower crash conduction element
7301 section of the crash conduction element from the crash box to the horizontal section
7302 horizontal section
7303 section of the crash conduction element from the horizontal section to the fixing element on the underframe support
731 holes for fixing the central buffer coupling
732 fixing device of the lower crash conduction element on the underframe support
733 crash box
734 plate

The invention claimed is:

1. Head module for a rail vehicle which is suitable to be detachably fixed to the end face of a coach section, wherein the end face of the coach section has a plurality of interfaces, which are provided for mounting the following:

two longitudinal beams of the underframe, which extend in the longitudinal direction on the lower edges of the coach section and the end faces of which are suitable for the installation of the head module, an underframe support which runs between the two longitudinal beams of the underframe and opens into the main cross beam which is mounted in the bogie of the coach section, wherein the end face of the underframe support is suitable for the installation of the head module, two longitudinal beams of the coach roof, which extend in the longitudinal direction on the upper edges of the coach section and the end faces of which are suitable for the installation of the head module, and the head module comprises an inner and an outer shell, and the following three systems which convert the impact energy into deformation one after the other or simultaneously and largely independently of one another in the event of a crash:

a stiffener designed as a ring beam in the roof area of the cab, which conducts forces into the upper longitudinal beams of the coach section, wherein the ring beam has a U shape in which the two ends of the ring beam are fixed to the upper longitudinal beams of the following coach section, a railing reinforcement which conducts impact forces into the lower longitudinal beams of the coach section via a force transmitting member running on the sides of the cab, wherein the railing reinforcement is arranged underneath a front window and above a crash box of the head module, a lower crash conduction element which is fitted with a crash box and in addition conducts the remaining impact energy into the underframe support, wherein a central buffer coupling is arranged on the lower crash conduction element after the section which leads from the crash box to the horizontal section of the lower crash conduction element, and the lower crash conduction element runs from the crash box, and the lower crash conduction element is arranged underneath the railing and above the central buffer coupling, diagonally downwards to underneath the base of the inner shell.

2. Head module according to claim 1, wherein the outer shell is designed in one piece and the inner shell is designed in several parts.

3. Head module according to claim 1, wherein the inner shell, the outer shell, the ring beam, the railing reinforcement and the force transmitting member as well as the lower crash conduction element are made from fibre composite material.

4. Head module according to claim 1, wherein the ring beam has at its ends metallic fixing devices for fixing to the upper longitudinal beam of the coach section.

5. Head module according to claim 1, wherein the ring beam is arranged in the upper part of the outer shell, above the inner shell.

6. Head module according to claim 1, wherein the force transmitting member are integrated into a lower part of the inner shell.

7. Head module according to claim 1, wherein in front of the crash box of the lower crash conduction element in the direction of movement of the head module, a plate made of carbon fibre composite material is arranged which absorbs a portion of the impact energy in the event of a crash.

8. Head module according to claim 1, wherein the lower crash conduction element runs from the crash box in a downward sloping manner in the direction of a horizontal section running underneath the cab base and after the horizontal section in an upward sloping manner to the fixing device of the lower crash element on the underframe support.

9. Head module according to claim 1, wherein the lower crash conduction element has a U-shaped cross section open towards the bottom.

* * * * *